United States Patent [19]

Anderson, Jr.

[11] 4,265,448

[45] May 5, 1981

[54] RACQUET SAFETY TETHER ASSEMBLY

[76] Inventor: Carl Anderson, Jr., Rte. 4, Missoula, Mont. 59801

[21] Appl. No.: 970,544

[22] Filed: Dec. 18, 1978

[51] Int. Cl.[3] ..... A63B 69/38

[52] U.S. Cl. ..... 273/29 A; 273/75

[58] Field of Search ..... 273/26 C, 29 A, 73 R, 273/73 J, 75, 76, 81 D, 54 B, 166, 190 B, 193 R, 194 R, 67 B, 165, 189 R, 189 A; 115/6.1; 9/307; 3/12.4, 12.5, 12.8; 128/165, DIG. 15; 145/61 R; 43/21.2; 401/6–8

[56] References Cited

U.S. PATENT DOCUMENTS

| | | | |
|---|---|---|---|
| 765,605 | 7/1904 | Wade | 273/84 R |
| 774,143 | 11/1904 | Adams | 273/75 X |
| 1,130,355 | 3/1915 | Von Eschen et al. | 273/84 R |
| 3,098,654 | 7/1963 | Larsen | 273/54 B |
| 3,113,782 | 12/1963 | Guier | 273/81 D X |
| 3,324,818 | 6/1967 | Dunlap | 273/75 X |
| 3,606,343 | 9/1971 | Lemon | 273/189 R |
| 3,693,973 | 9/1972 | Wattenburg | 273/189 A X |
| 3,858,881 | 1/1975 | Hurwitz | 273/73 R X |
| 4,150,821 | 4/1979 | Racz | 273/29 A |
| 4,176,839 | 12/1979 | Pinkus | 128/165 X |

FOREIGN PATENT DOCUMENTS

| | | | |
|---|---|---|---|
| 821653 | 8/1937 | France | 273/166 |
| 16681 | of 1903 | United Kingdom | 273/75 |
| 160400 | 3/1921 | United Kingdom | 273/75 |
| 205442 | 10/1923 | United Kingdom | 273/75 |

*Primary Examiner*—Richard J. Apley
*Attorney, Agent, or Firm*—Arthur L. Urban

[57] ABSTRACT

A racquet safety tether assembly including a wrist-encircling portion and racquet handle-connecting portion, the wrist-encircling portion comprising a flexible band member, fastening means associated with each end of the band member, cord-holding means disposed along the length of the band member intermediate the ends thereof, the cord-holding means maintaining one cord end in a fixed position with respect to the band member, the racquet handle-connecting portion comprising a single cord having structural integrity, one end of the cord being affixed to the cord-holding means of the wrist-encircling portion, and the opposite free end of the cord including fastening means capable of connection to the end of a racquet handle.

7 Claims, 4 Drawing Figures

RACQUET SAFETY TETHER ASSEMBLY

This invention relates to a novel safety tether and more particularly relates to a new safety tether assembly for racquets.

In the playing of sports which require the use of a racquet, the possibility exists that a player may lose his grip as he swings his racquet. Generally, the racquet simply flies through the air until it loses its velocity and falls to the ground or other base surface. In most racquet and paddle sports, the opposng players are positioned far enough from each other that the danger of being hit by an opponent's flying racquet is very remote.

However, with racquet sports such as racquetball in which the players are in a confined area and in close proximity to each other, the danger of being struck by a flying racquet is greatly increased. To minimize this danger, it is customary to employ a safety tether with racquetball racquets. This safety tether generally is a loop of cord which extends through a crosspin secured within a cavity in the end of the racquet handle.

A player slips his hand through the free portion of the loop and then grasps the racquet handle with his normal grip. Ordinarily, the racquet is twisted to shorten the tether and secure it more firmly to the wrist. This reduces the chance of the tether slipping off the player's hand if he loses his grip and allowing the racquet to fly away. One of the problems with this arrangement is achieving the desired degree of tension in the tether.

If the tether is too loose, the tether will slap against the back of the player's hand as he swings his racquet and may slip off his wrist. On the other hand, if the tether is wound too tightly, the tightness may have a restricting or hobbling effect on the player's swinging of the racquet, particularly on a back stroke where it is desirable to have an upward extension of the wrist joint before impact. This restriction of the player's stroke can result in the shots having a lack of power and poor shot control.

Even if a player can achieve the desired tension in the twisted tether for good shot making, the loop may cause discomfort to the player by irritation or chafing of the wrist and hand. In this case, a player is faced with the dilemma of ignoring the discomfort in order to achieve good shot control and power or loosening the tether tension to relieve the discomfort at the sacrifice of adversely affecting the proficiency of his shot making. Since neither solution is desirable, many players adjust the tension in the tethers by twisting or untwisting their racquets between points. All of this activity in adjusting the tension in the safety tether interferes with a player's concentration and of necessity detracts from his proficiency.

It has been proposed to utilize a wrist band with an insert which is slidable longitudinally of the band. The insert has grommets at each end onto which the ends of the tether are attached. Although this structure assists in securing the tether to the wrist, it does not eliminate the bulkiness encountered with conventional racquet tethers. Thus, none of the safety tethers presently available for racquets answer the player's needs.

The present invention provides a novel safety tether assembly which does not restrict a player's stroke. Also, the tether assembly of the invention minimizes the distractive effects of safety tethers. Furthermore, the tether assembly can be adjusted conveniently to fit individuals with different hand and wrist sizes. In addition, the tether assembly of the invention eliminates the necessity for twisting the tether to achieve proper tension in the tether. Rather, the tether assembly resists twisting to facilitate alignment with their racquet.

The safety tether assembly of the invention is simple in design and light in weight. Also, the tether assembly can be fabricated from commercially available materials and components employing conventional glove fabricating techniques. Moreover, the tether assembly can be color-coordinated with a player's outfits. The simple attachment of the tether to the racquet handle allows it to be switched quickly and easily as desired. In addition, the tether assembly can be fabricated relatively inexpensively.

Other benefits and advantages of the novel safety tether assembly of the present invention will be apparent from the following description and the accompanying drawings in which.

Figure 1:
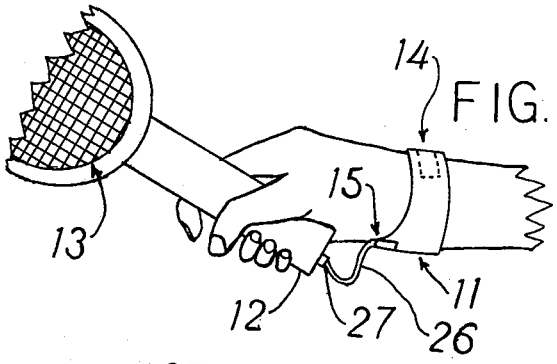
FIG. 1 is a schematic illustration of one form of the safety tether assembly of the invention attached to a racquet handle and the wrist of a player.

As shown in the drawings, one form of the novel tether assembly 11 of the invention is attached to the end of a handle 12 of a racquetball racquet 13. Tether assembly 11 includes a wrist-encircling portion 14 and a racquet handle-connecting portion 15.

Figure 2:
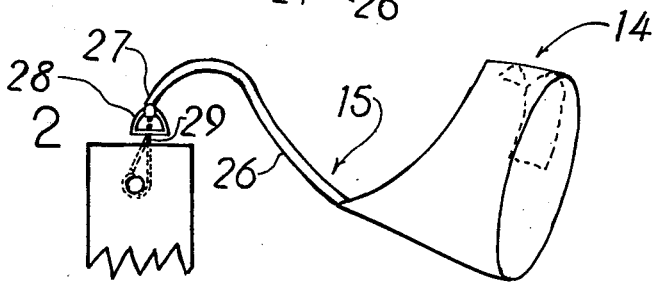
FIG. 2 is an illustration of the tether assembly of FIG. 1 in a closed position.
Figure 3:
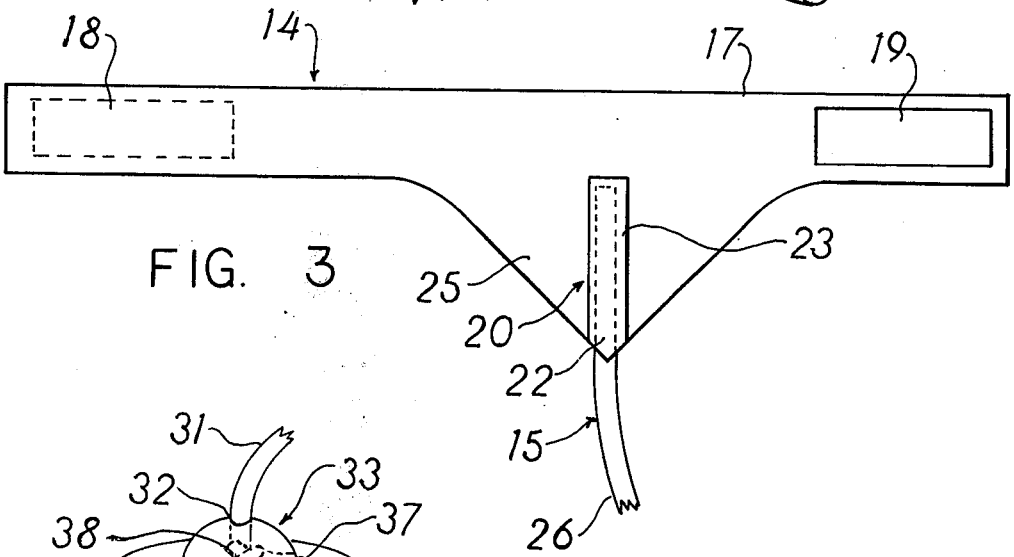
FIG. 3 is a top view of the tether assembly of FIGS. 1 and 2 in an open position.

The wrist-encircling portion 14 includes a flexible band member 17 with fastening means 18 and 19 associated with each end thereof. Advantageously, the fastening means 18 and 19 as shown include a napped fabric section and a hooked fabric section on the opposite face of the other end of the band member 17. Thus, the overlapping of the ends of the band member 17 when the band member encircles a wrist of a player as shown in FIG. 1 brings the napped fabric section into contact with the hooked fabric section on the opposite face of the other end of the band member as shown in FIG. 2 more clearly. This arrangement secures the tether assembly snugly to the wrist of the player while providing a comfortable fit that does not distract the player nor detract from his shot making. Fastening means of this type are sold under the trademark, Velcro.

The wrist-encircling portion 14 also includes cord-holding means 20. The cord-holding means 20 is disposed along the length of band member 17 intermediate the ends thereof. The cord-holding means 20 maintains the end of a cord 22 in a fixed position with respect to the band member 17. This may be accomplished as shown by securing an overlay 23 to the band member and affixing the cord end 22 therebetween. The band member 17 advantageously has a section 25 of greater width adjacent the cord end-holding means 20. Preferably, the greater width section 25 extends from one edge of the band member to form an asymmetrical projection therefrom.

The racquet handle-connecting portion 15 includes a single cord 26 which has structural integrity, that is, the cord has a degree of stiffness. As pointed out above, one end 22 of cord 26 is affixed to wrist-encircling portion 14. The opposite free end 27 of cord 26 includes fastening means capable of connection to the end of racquet handle 12. Cord 26 advantageously has a cross section with substantially the same width and height such as a square or circle. Preferably, the cross section of the cord 26 is substantially circular, although it may be slightly oval in shape if desired without adversely affecting the performance of the tether assembly.

The fastening means 27 at the free end of the cord 26 advantageously includes swivel means 28 as shown in FIG. 2. The swivel means 28 preferably may be combined with snap means 29.

Figure 4:
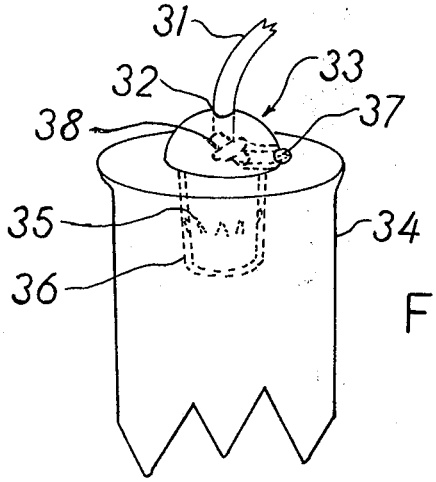
FIG. 4 is an enlarged view of another racquet-fastening portion of the tether assembly of the invention.

FIG. 4 illustrates another form of fastening means for the racquet handle 12 and the cord end. As shown, a cord 31 has the end thereof inserted into an opening 32 in an end cover 33 of racquet handle 34. End cover 33 has a barbed, threaded or other outer surface 35 that engages a cavity 36 in the end of handle 34. Cord 31 is secured to end cover 33 by threading the end of the cord through opening 32 and out a peripheral opening 37 thereof. The cord end then is knotted and the knot 38 drawn back under cover 33 and against the internal shoulder of the cover surrounding opening 32. Cord 31 may be pulled taut to seat knot 38 against the shoulder. This cord arrangement provides an effective swivel action.

In the use of the safety tether assembly of the invention as shown in the drawings, the free end of the cord 26 or 31 is fastened to the end of racquet handle 12 or 34 through the use of snap means 29 or knot 38, respectively. The length of the cord may be adjusted for proper fit of the tether assembly by the position of the knot 38 or by the point of attachment of the snap 29 to the cord. Thereafter, band member 17 is wrapped around the wrist of the player and fastening means 18 and 19 interconnected to provide the desired fit. The tether assembly may be adjusted for fit by changing the length of the cord between the wrist-encircling portion 15 and the racquet handle 12. Similarly, the fit of the wrist-encircling portion can be changed by adjusting the overlap of the fastening means 18 and 19.

The above description and the accompanying drawings show that the present invention provides a novel safety tether assembly which is convenient to use and does not distract the player and thereby reduce his proficiency. Furthermore, the safety tether assembly of the invention does not interfere with the player's stroke. Also, the safety tether can be adjusted easily and quickly so as to fit persons of different hand and wrist measurements. In addition, the tether assembly of the invention does not require any twisting of the tether to adjust the fit thereof.

The safety tether assembly of the present invention is simple in design and light in weight. Also, the tether can be color-coordinated to match or blend with a player's outfits. Further, the tether assembly can be changed easily to make the color-coordination simple. The tether assembly can be fabricated from commercially available materials and components relatively inexpensively using commercial manufacturing techniques.

It will be apparent that various modifications can be made in the particular tether assembly described in detail above and shown in the drawings within the scope of the invention. For example, the tether assembly can be made from leather or a similar man-made material. In addition, the size and configuration of the parts of the tether assembly may be changed to meet specific requirements. Therefore, the scope of the invention is to be limited only by the following claims.

What is claimed is:

1. A racquet safety tether assembly including a wrist-encircling portion and a racquet handle-connecting portion, said wrist-encircling portion comprising a flexible band member, fastening means associated with each end of said band member, said band member having a section of greater width extending from one edge of said band member, cord-holding means disposed adjacent said section of greater width of said band member, said racquet handle-connecting portion comprising a single cord having structural integrity, one end of said cord being affixed to said cord-holding means of said wrist-encircling portion, said cord-holding means maintaining said one cord end in a fixed perpendicular position with respect to said band member and in substantially the same plane thereof, and the opposite free end of said cord including fastening means capable of connection to the end of a racquet handle, said fastening means including a male socket portion engageable with a cavity in the butt end of a racquet handle and extending longitudinally thereof, said male socket portion including an end cover with an opening into which a cord end is inserted and including a shank section of substantial thickness with securing means for affixing said shank section to said cavity, whereby when said wrist-encircling portion is positioned around a player's wrist and fastened, said cord-holding means will maintain said one cord in a fixed perpendicular position extending toward the player's hand.

2. A racquet safety tether assembly according to claim 1 wherein said fastening means associated with each end of said band member includes a napped fabric section on one end thereof and a hooked fabric section on the opposite face of the other end of said band member.

3. A racquet safety tether assembly according to claim 1 wherein said cord has a cross section with substantially the same width and height.

4. A racquet safety tether assembly according to claim 1 wherein said cord has a cross section which is substantially circular.

5. A racquet safety tether assembly according to claim 1 wherein said fastening means on the free end of said cord includes snap means.

6. A racquet safety tether assembly according to claim 1 wherein said fastening means on the free end of said cord includes swivel means.

7. A racquet safety tether asembly according to claim 1 wherein said wrist-encircling portion is fabricated of a leather-like material.

* * * * *